US005980646A

United States Patent [19]

DeRosa

[11] Patent Number: 5,980,646

[45] Date of Patent: Nov. 9, 1999

[54] CONTINUOUS WEB CLEANER

[76] Inventor: Richard D. DeRosa, 4785 Ranchwood Rd., Bath, Ohio 44333

[21] Appl. No.: 08/816,871

[22] Filed: Mar. 13, 1997

[51] Int. Cl.[6] ..... A47L 5/00; A47L 7/00

[52] U.S. Cl. ..... 134/21; 15/1.51; 15/308; 15/309.1; 134/9

[58] Field of Search ..... 15/1.51, 306.1, 15/308, 309.1; 134/9, 21; 361/214, 221, 222, 220

[56] References Cited

U.S. PATENT DOCUMENTS

| | | | |
|---|---|---|---|
| 2,015,583 | 9/1935 | Bartsch | 15/308 |
| 3,045,273 | 7/1962 | Bruno | 15/309.1 |
| 3,272,651 | 9/1966 | Quirk | 15/309.1 |
| 3,395,042 | 7/1968 | Herbert, Jr. . | |
| 3,536,528 | 10/1970 | De Geest . | |
| 3,986,223 | 10/1976 | Kiefer | 15/309.1 |
| 4,378,610 | 4/1983 | Ermer et al. | 15/1.51 |
| 4,454,621 | 6/1984 | Testone . | |
| 4,835,808 | 6/1989 | Hahne et al. . | |
| 5,008,968 | 4/1991 | Preston . | |
| 5,028,959 | 7/1991 | Gooray . | |
| 5,211,760 | 5/1993 | Kedarnath . | |
| 5,276,936 | 1/1994 | Corrigan . | |
| 5,331,503 | 7/1994 | McGarry et al. | 361/214 |
| 5,596,783 | 1/1997 | Testone | 15/309.1 |

*Primary Examiner*—Terrence R. Till
*Attorney, Agent, or Firm*—Oldham & Oldham Co.,LPA

[57] ABSTRACT

A continuous web cleaner having two elongated manifolds, each having an elongated row of brushes attached to either side of the manifold with both manifolds being physically oriented such that they face each other. The manifolds are offset from one another so that a continuous paper web can pass in between and through the two elongated manifolds. Each manifold is coupled to an exhauster outside or inside the room which creates a vacuum to remove paper dust, chad and other contaminants from the paper web itself and any contaminants collected by the elongated rows of brushes. Static electrical charges are removed from both sides of the continuous paper web by elongated static eliminator bars mounted at the input and output of the apparatus, both below and above the paper web. The continuous web cleaner can be used on the input side of electronic printers, used in conjunction with roll paper unwind equipment and/or used after the electronic printer if necessary for post processing equipment such as roll paper rewinders, folders and cutters.

27 Claims, 3 Drawing Sheets

CONTINUOUS WEB CLEANER

TECHNICAL FIELD

The present invention relates to a paper cleaning apparatus and more specifically to a stanchion continuous web cleaner which removes paper dust, chad and static electricity from paper webs either before and/or after the webs are fed into electronic printing equipment.

BACKGROUND OF THE INVENTION

Today a great deal of printed material which people receive is part form letter and part personalized for the individual receiving the document. Through the use of computers and high-speed electronic variable data printers, these customized documents can be created automatically with custom information being supplied by a computer database. One of the features that increases the speed at which the electronic variable data printers can process paper is by being fed a continuous web or roll of paper rather than individual sheets or fanfold perforated paper.

The major manufacturers and resellers of electronic continuous web printers are IBM, OCE and Xerox. The speed of these types of printers is continually increasing and are currently capable of running at speeds of up to 310 feet per minute of paper web which equates to about 466 pages of customized letters per minute. Such electronic high speed continuous web printers are extremely expensive and can cost several hundred thousand dollars making proper maintenance of the printers essential and down or stop time costly.

One of the largest obstacles to keeping electronic continuous web printers running correctly is the accumulation of paper dust, chad and static within the printer. Paper dust and chad gathers upon components within the printer which can cause the printer to jam, stop and function irregularly. These unwanted particles within the printer also cause contamination of the final printed product as well as internal printer mechanisms making it unacceptable to customers causing time and money to be wasted. Static electricity built up on the paper web furthers the accumulation of contaminants as it tends to attract paper dust and chad within the environment. In addition, static electric charges cause damage to the electronic components within the electronic variable data printers causing significant periods of down time and costly repairs.

Up to now all that could be done to prevent damage to the electronic printers and the printed product itself was to periodically stop the printing process and clean the paper dust and chad from the printer using a vacuum or other miscellaneous tools. Significant costs are attributed to this type of maintenance because there is down time in which no printed product can be produced while the cleaning is being done and additional manpower must be expended as the cleaning must be done manually. Consumables such as toner and developer must also be replaced more often as they to become contaminated by the paper dust.

An additional problem caused by the paper dust and chad is that because the paper webs are being processed at high speeds some of the dust is discharged into the surrounding work environment and poses significant health problems for workers in and around the electronic continuous web printers.

Therefore, in light of the foregoing deficiencies in the prior art, the applicants invention is herein presented.

SUMMARY OF THE INVENTION

Based upon the foregoing, there has been found a need to provide a continuous web cleaning apparatus to remove paper dust, chad and static from a web of paper prior to it being fed into and/or out of a high speed electronic variable printer. To further increase printed product throughput there is also a need to remove static electric charges from the paper webs while removing paper dust and chad.

It is therefore a main object of the invention to provide a continuous web cleaning apparatus which removes, paper dust, chad, static and other contaminates from a web of paper after it leaves the roll paper unwinder before it is fed to an electronic variable printer.

It is another object of the invention to provide a continuous web cleaning apparatus which removes static electric charges from paper webs in order to decrease the webs resistance, prevent contaminants from adhering to the paper web and increase printed product throughput.

Another object of the invention is to reduce paper dust, chad and other contaminants from the work environment thereby providing a safer and healthier environment for employees working around high speed electronic variable printers.

These and other objects and advantages of the invention are accomplished through the use of two elongated manifolds, each having an elongated row of brushes attached to either side of the manifold with both manifolds being physically oriented such that they face each other. The manifolds are offset from one another so that a continuous paper web can pass in between and through the two elongated manifolds. Each manifold is coupled to an exhauster which creates a vacuum to remove paper dust, chad and other contaminants from the paper web itself and any contaminants collected by the elongated rows of brushes. Static electrical charges are removed from both sides of the continuous paper web by elongated static eliminator bars mounted at the input and output of the continuous paper web cleaning apparatus, both below and above the paper web. Elongated rollers on the input and output of the web cleaner apparatus assist and maintain the webs alignment as it is being passed through the apparatus which further increases throughput and eliminates downtime. The apparatus also contains an automatic control system coupled to a motion sensor which detects when the electronic variable printer is halted, thereby halting the throughput of the continuous web. When the control system detects that the printing process has been stopped it will shut down the exhauster which saves electricity and cuts down on noise pollution within the work environment. As soon as the printing process is restarted, the control system will reengage the exhauster to once again provide continuous web cleaning. The apparatus also contains an override switch if automatic control is not desired and an external vacuum wand is included making routine, preventative and occasional manual cleaning quick and easier than the prior methods of using a shop vacuum.

The continuous web cleaner can be used on the input side of electronic printers, used in conjunction with roll paper unwind equipment and/or used after the electronic printer if necessary for post processing equipment such as roll paper rewinders, folders and cutters.

DETAILED DESCRIPTION OF THE PREFERRED EMBODIMENT

Figure 1:
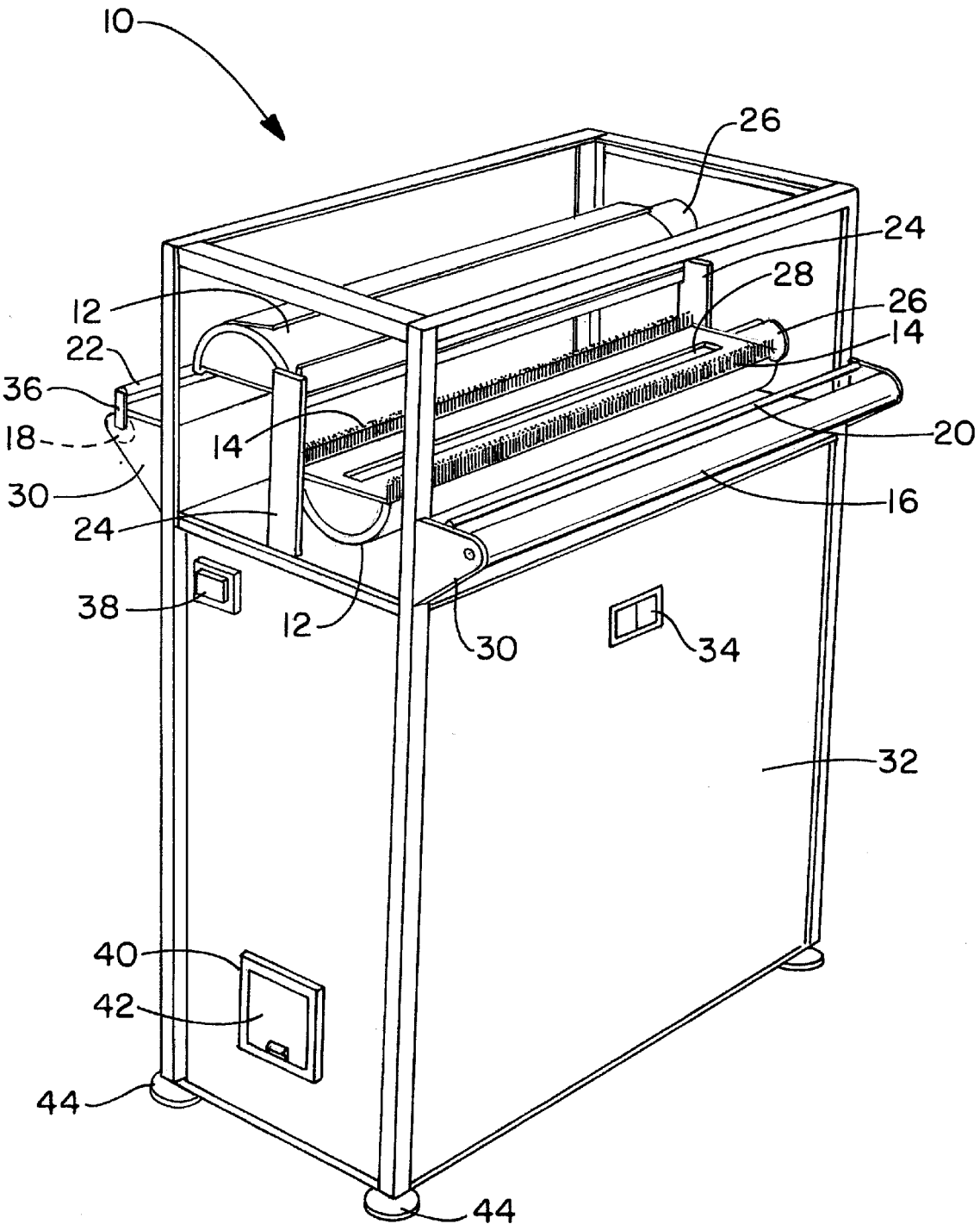
FIG. 1 is a perspective view of the continuous web cleaning apparatus of the present invention.

FIG. 1 shows a preferred embodiment of continuous web cleaning apparatus 10 which is used as a stand alone or stanchion apparatus to remove paper dust, chad and static electrical charges from continuously fed webs of paper. Apparatus 10 is comprised of base 32 which is essentially an enclosure used to elevate the main components necessary for cleaning the continuous paper web to an acceptable height. Base 32 provides the additional benefit of an area to house hoses, wiring and other components. Coupled to the bottom and four corners of base 32 are adjustable leveling feet 44 which provide a stable platform for apparatus 10 upon a floor surface. Each adjustable leveling foot 44 may be extended or retracted from the bottom of base 32 to maintain apparatus 10 in a level position even when placed upon a floor surface that is not level.

On top of base 32 of continuous web cleaning apparatus 10, two manifolds 12 are mounted in operable cooperation with one another. Each manifold 12 is elongated and includes an elongated slot 28 into which paper dust, chad and other contaminants are drawn when manifold 12 is coupled to an exhauster, which will be described in detail later. Each manifold 12 also includes two elongated rows of brushes 14, one located on either side of elongated slot 28. Brushes 14 remove and loosen paper dust, chad and other contaminants from the continuous paper web which is collected by manifolds 12 through elongated slots 28. Two manifolds 12 are coupled to one another and then to base 32 through mounting brackets 24. The two manifolds 12 are physically arranged such that their brushes 14 and elongated slots 28 are facing one another so that each manifold 12 treats one side of the continuous paper web as it is fed through and between the two manifolds 12. Mounting bracket 24 in the preferred embodiment is simply a piece of metal or aluminum which uses standard means of coupling such as screws and bolts to secure manifolds 12 to one another and then to base 32 of continuous web cleaning apparatus 10. Each manifold 12 includes coupling pipe 26 extending from one side to provide an interface between manifold 12 and an external exhauster. Although not shown, the external exhauster provides manifolds 12 with the vacuum force needed to remove paper dust and chad from the paper web as it passes through apparatus 10.

To maintain proper alignment of the continuous paper web as it is processed by cleaning apparatus 10 a feed mechanism including guides such as, input and output rollers, 16 and 18 respectively, are coupled to base 32 by a plurality of mounting brackets 30. Both input and output rollers 16 and 18 are elongated and are mounted in parallel with elongated manifolds 12. Both rollers 16 and 18 are mounted near the top of base 32 and at the same height in order to maintain the continuous web of paper in a planar position as it is being passed between and through manifolds 12. By maintaining the continuous paper web in an optimum position, manifolds 12 and brushes 14 are most effective and overall throughput of the continuous paper web is maximized.

To further improve web throughput, continuous web cleaning apparatus 10 is equipped with input and output static eliminators 20 and 22. Input and output static eliminators 20 and 22 are shockless to provide safety to users and consist of elongated bars which neutralize static electrical charges built up upon the continuous paper web through either passive or active AC elimination systems. Input static eliminator 20 is coupled between input roller mounting brackets 30 so that as the continuous paper web is passed over input roller 16 and then between manifolds 12 it will also pass over input static eliminator 20 to neutralize any static electrical charges built up on either side of the continuous paper web. By eliminating static charges from the continuous paper web before it passes through manifolds 12 and brushes 14, the additional attractive force on the paper dust and chad is neutralized making the contaminants easier to remove.

To neutralize static electric charges on the continuous paper web after it leaves manifolds 12 and brushes 14, output static eliminator 22 is coupled to output roller 18's mounting brackets 30 through extended brackets 36 which slightly elevate output static eliminator 22 above output roller 18. As the continuous paper web leaves cleaning apparatus 10 it passes over output roller 18 but under output static eliminator 22 which neutralizes static electric charges from both sides of the paper web. Any additional static charges that may have built up on the paper web due to manifolds 12 and brushes 14 is removed just prior to the paper web being fed to the electronic variable data printer which prevents the static charges from damaging the printer's internal electronic components.

Although not shown, base 32 of continuous web cleaning apparatus 10 houses a control system or controller 35 which once enabled automatically turns apparatus 10 on and off by controlling an external exhauster, located outside of the print room and not shown, which provides suction to manifolds 12. The control system 35 could be comprised of relays, digital logic circuits or even microprocessor controlled, all of which are known in the art and all can easily be used or interchanged for simple state detection and on/off control. The control system 35 reacts based upon detection of paper movement by paper detection sensor 34. Manual/automatic selection switch 38 is provided so the user can either enable the automatic control previously described or allow apparatus 10 to be controlled manually. Switch 38 is physically mounted to base 32 and although not shown is electrically coupled to an internal control system 35 which itself is electrically coupled to paper detection sensor 34 and any external equipment to be controlled such as the external exhauster.

An additional feature is vacuum wand interface 40 which is physically coupled to one side of base 32 and within base 32 is coupled to the external exhauster through similar means as both manifolds 12. Vacuum wand interface 40 includes door 42 which when closed seals interface 40 preventing any suction from being generated through interface 40 thereby providing the full vacuum generated by the external exhauster to manifolds 12 for maximum cleaning efficiency.

Figure 2:
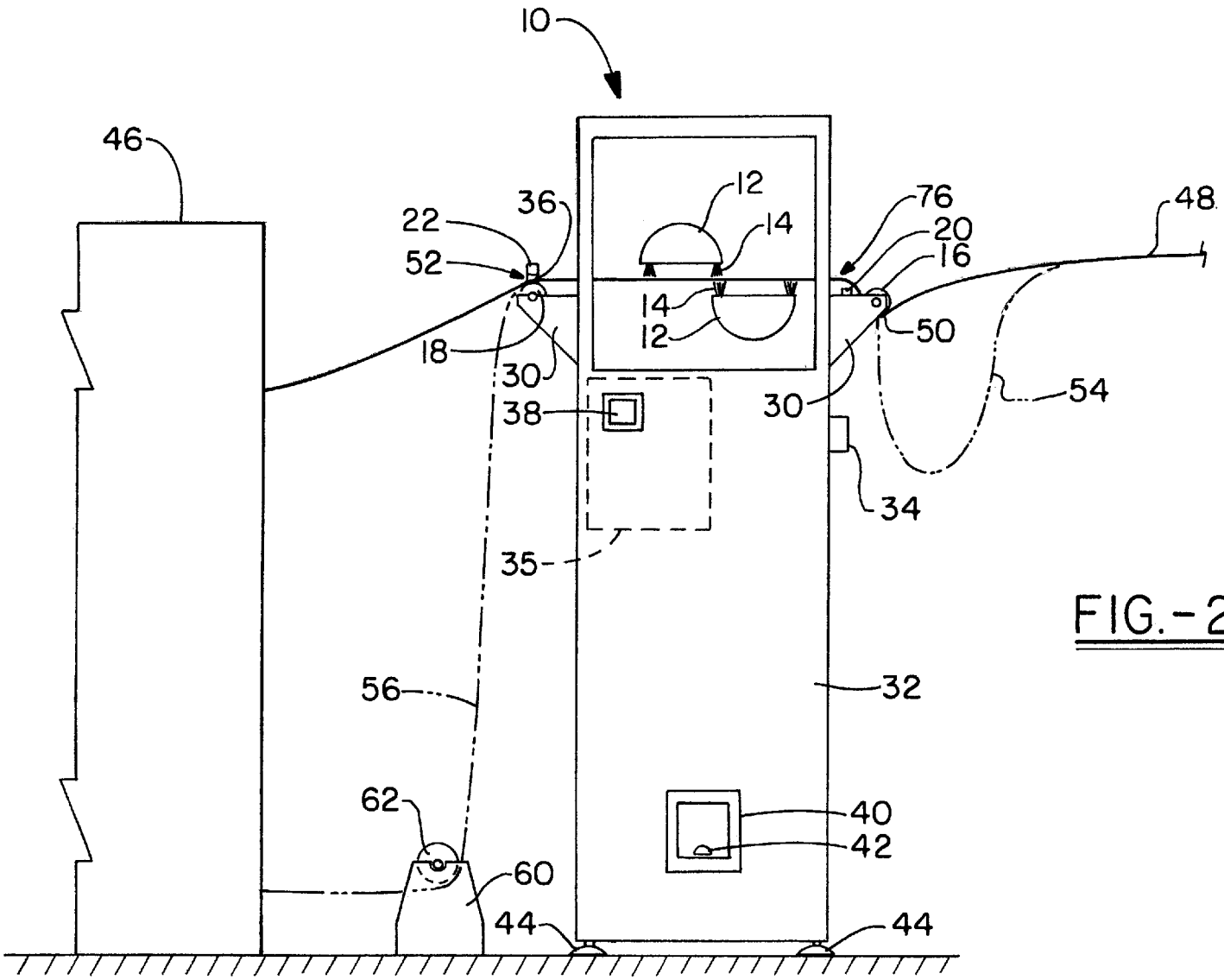
FIG. 2 is a side elevational view of the continuous web cleaning apparatus shown in FIG. 1 while processing a continuous paper web as it is supplied to an electronic variable printer.

FIG. 2 shows continuous web cleaning apparatus 10 in operation and positioned between a source of paper web 48 and electronic variable printer 46. In FIG. 2 paper web 48 initially starts at a higher elevation than guide or input roller 16 of the feed mechanism of apparatus 10 and, therefore paper web 48 is fed under input roller 16 at position 50 and then over input static eliminator 20. If paper web 48 is fed to apparatus 10 from a lower elevation than input roller 16, paper web 48 would be fed over input roller 16 as described earlier for FIG. 1. Use of elongated input roller 16 provides the necessary versatility so apparatus 10 can be used in a number of different environments in which different roll paper unwind equipment with different physical characteristics are used. Once paper web 48 has been fed through and between manifolds 12 and their associated brushes 14, paper web 48 passes over guide or output roller 18 at position 52 and under output static eliminator 22. From there paper web 48 is fed into electronic variable printer 46 for further processing. To ensure that continuous web cleaning apparatus 10 can be coupled to different types and brands of electronic printers having input ports at varying elevations, low level output guide 60 is provided. Low level output guide 60, although only shown from the side in FIG. 2, is simply a bracket which holds elongated roller 62. Paper web 48 is fed along low level path 56 and under elongated roller 62 which keeps paper web 48 aligned correctly as it is fed into electronic printer 46's low elevation input port.

At this time, the automatic functioning of continuous web cleaning apparatus 10 will be described in greater detail. When a user places apparatus 10 in automatic mode through manual/automatic selection switch 38, a controller or control system 35 located within base 32, will automatically turn external devices such as the exhauster on and off based upon feedback from paper detection sensor 34. As long as electronic printer 46 is printing, paper web 48 will remain taut or under tension as it feeds to the feed mechanism including tension input roller 16 at point 50 as shown by the solid line. When electronic printer 46 is halted it will no longer receive paper web 48 thereby causing web 48 to droop or create a loop 54 which will pass in front of paper detection sensor 34. As web loop 54 is indicative of electronic printer 46 being turned off or halted, cleaning apparatus 10's internal control system 35 will then disable external equipment such as the exhauster based upon detection of loop 54 by detection sensor 34. When electronic printer 46 is again turned on loop 54 will disappear as paper web 48 again is pulled taut and detection sensor 34 will signal apparatus 10's control system 35 to restart or enable external devices such as the exhauster. This automatic on/off function conserves electricity or other types of power by only running the exhauster or other external equipment during the actual printing process. By shutting the exhauster down when electronic printer 46 is not functioning also cuts down on noise within the working environment benefiting workers in and around the printing equipment.

One of the purposes in being able to place continuous web cleaning apparatus 10 in manual mode through manual/automatic selection switch 38 is so that the external exhauster will remain on despite paper web 48 looping 54 in front of detection sensor 34. This allows suction to be maintained at vacuum wand interface 40 when the user wishes to perform manual cleaning of electronic printer 46 while the printer is not functioning.

Figure 3:
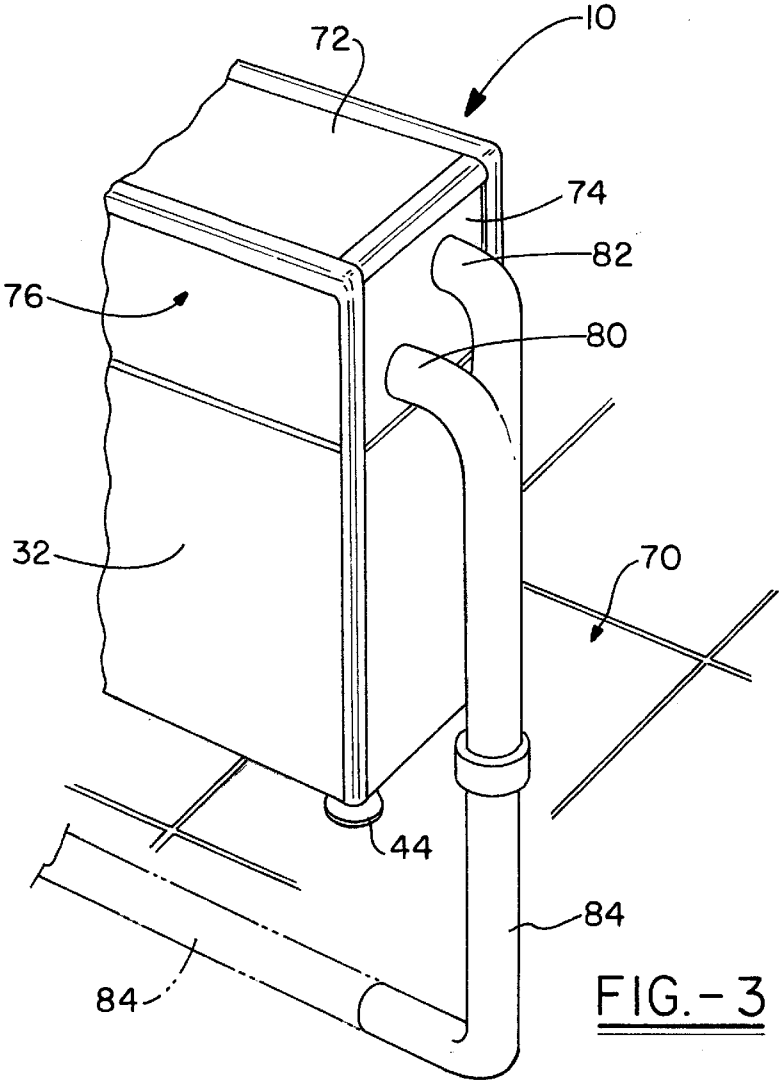
FIG. 3 is a partial perspective view of the exhauster-to-manifold coupling arrangement used with the continuous web cleaning apparatus of FIG. 1.

FIG. 3 shows continuous web cleaning apparatus 10 situated upon raised floor 70 which provides an area beneath apparatus 10 for external exhauster coupling pipes 84. Connected to coupling pipes 26 of manifolds 12 are exhauster coupling pipes 80 and 82 which either run together and as a single coupling pipe are attached to external exhauster coupling pipe 84 or are separately coupled to coupling pipe 84. While the preferred embodiment is designed for underfloor exhauster coupling, pipes 80 and 82 can also be reversed to extend upward having external exhauster coupling pipe 84 run along the ceiling of the facility housing the printing equipment. While not shown external coupling pipe 84 can include a regulator at the junction between it and exhauster coupling pipes 80 and 82 to maintain the correct amount or volume of vacuum draw at manifolds 12.

Although not essential in the preferred embodiment, continuous web cleaning apparatus 10 will include solid top 72 and solid side cover 74 with a slot 76 to accept web 48. Slot 76 can be completely open or partially covered by plexiglass or a similar material as long as enough room is left open for continuous paper web 48 to be fed through apparatus 10.

Figure 4:
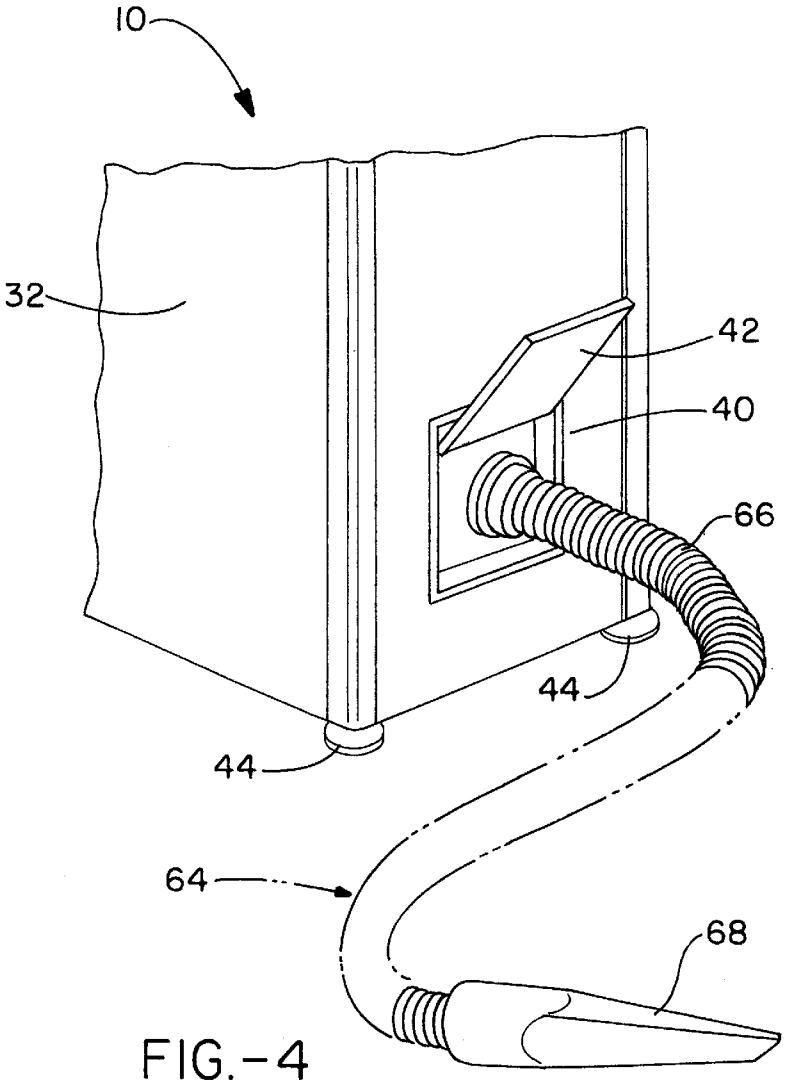
FIG. 4 is a partial perspective view of the continuous web cleaning apparatus showing the manual vacuum wand.

FIG. 4 shows vacuum wand interface 40 with vacuum wand 64 coupled to and extending from base 32 for use in manually cleaning any paper dust, chad or other contaminants not previously disposed of by apparatus 10. Vacuum wand 64 is comprised of hose 66 coupling vacuum wand interface 40 with nozzle 68 which allows a user to manually clean either apparatus 10 or other pieces of nearby equipment such as the electronic printers which receive continuous paper web 48 from apparatus 10. Although not shown, Applicant contemplates other variations of vacuum wand 64 such as a retractable version in which hose 66 is coupled to a retractable mechanism mounted within base 32 for convenient storage and use. Again external coupling pipe 84 can include a regulator at the junction between it and vacuum wand interface 40 to maintain the correct amount or volume of vacuum draw through vacuum wand 64.

Although the principles, preferred embodiments and preferred operation of the present invention have been described in detail herein, this is not to be construed as being limited to the particular illustrative forms disclosed. It will thus become apparent to those skilled in the art that various modifications of the preferred embodiments herein can be made without departing from the spirit or scope of the invention as defined by the appended claims.

What is claimed is:

1. An apparatus for treating a continuous web of material comprising:

a housing including a feed mechanism to accept and transport said continuous web under tension and containing at least one manifold therein coupled to a vacuum source, said housing having at least one slot adjacent said at least one manifold through which said continuous web is transported for treatment, wherein said web is treated as it moves through said slot.

2. An apparatus for treating a continuous web as recited in claim 1, further comprising at least one brush operatively coupled to said apparatus to come in contact with and treat said web as it moves through said slot.

3. An apparatus for treating a continuous web as recited in claim 1, further comprising at least two brushes operatively coupled to said apparatus, wherein the combination of said at least two brushes comes in contact with and treats both sides of said web as it moves through said slot.

4. An apparatus for treating a continuous web as recited in claim 1, further comprising a second manifold operatively coupled to said vacuum source so that said manifolds face one another.

5. An apparatus for treating a continuous web as recited in claim 1, further comprising at least one static eliminator operatively coupled to said apparatus for neutralizing static electric charges built up upon said web.

6. An apparatus for treating a continuous web as recited in claim 1, further comprising at least two static eliminators operatively coupled to said apparatus for neutralizing static electric charges built up upon said web.

7. An apparatus for treating a continuous web as recited in claim 6, wherein said at least two static eliminators are operatively coupled above and below said web to neutralize static electric charges built up upon both sides of said web.

8. An apparatus for treating a continuous web as recited in claim 1, further comprising at least two static eliminators operatively coupled to said apparatus for neutralizing static electric charges built up upon said web, wherein at least one of said static eliminators is coupled to a first side of said housing and at least one of said static eliminators is coupled to a second side of said housing.

9. An apparatus for treating a continuous web as recited in claim 1, wherein said vacuum source is supplied by an exhauster.

10. An apparatus for treating a continuous web as recited in claim 1, wherein said vacuum source is supplied by a source of negative pressure.

11. An apparatus for treating a continuous web as recited in claim 1, further comprising an input guide coupled to a first side of said housing for directing said web into said apparatus.

12. An apparatus for treating a continuous web as recited in claim 1, further comprising an output guide coupled to a second side of said housing for directing said web out of said apparatus.

13. An apparatus for treating a continuous web as recited in claim 1, further comprising a controller which enables said apparatus when said web is moving through said apparatus and disables said apparatus when said web is stationary.

14. An apparatus for treating a continuous web as recited in claim 13, said controller further comprising a sensor which detects whether said web is moving or stationary and instructs said controller as to whether said paper web is moving or stationary.

15. An apparatus for treating a continuous web as recited in claim 1, wherein said apparatus is a self-contained, stand alone unit for treating said web.

16. An apparatus for processing and treating a continuous web comprising:

a source of web material which supplies said web material to a web treatment station, said web treatment station including an apparatus having a housing coupled to a vacuum source, said housing having at least one slot defining a means through which said web is fed for treatment, with said web being treated as it moves through said slot, and processing equipment to receive said web after treatment at said web treatment station to process said web in an in-line operation, wherein said housing of said apparatus of said web treatment station is selectively positionable at a location intermediate said source of web material and said processing equipment to facilitate treating of said web and movement of said web therebetween.

17. An apparatus for treating a continuous web as recited in claim 16, further comprising at least one brush operatively coupled to said apparatus to come in contact with and treat said web.

18. An apparatus for treating a continuous web as recited in claim 16, further comprising at least one static eliminator operatively coupled to said apparatus for neutralizing static electric charges built up upon said web.

19. An apparatus for treating a continuous web as recited in claim 16, further comprising a controller which enables said apparatus when said web is moving through said apparatus and disables said apparatus when said web is stationary.

20. An apparatus for treating a continuous web as recited in claim 16, wherein said vacuum source is supplied by an exhauster.

21. An apparatus for treating a continuous web as recited in claim 16, wherein said vacuum source is supplied by a source of negative pressure.

22. An apparatus for treating a continuous web as recited in claim 16, wherein said apparatus is a self-contained, stand alone unit for treating said web.

23. A method of treating a continuous web of material, comprising the steps of:

(a) providing a housing member, said housing containing at least one manifold coupled to a source of negative pressure, and said housing having at least one slot adjacent said at least one manifold through which said web is fed for treatment and having a feed mechanism to accept and transport said web under tension;

(b) guiding said web along substantially a plane adjacent said at least one manifold through said slot; and (c) treating said web as it moves past said at least one manifold to remove contaminants by negative pressure produced by said source of negative pressure.

24. A method of treating a continuous web as recited in claim 23, further comprising treating said web to neutralize static electricity built up upon said web.

25. An apparatus for treating a web of material having top and bottom surfaces comprising:

a housing coupled to a vacuum source, said housing having at least one slot through which said web is fed for treatment, wherein said web is treated a it moves through said slot, and at least two static eliminators operatively coupled to said apparatus for neutralizing static electric charges built upon both of said top and bottom surfaces of said web, wherein at least one of said static eliminators is coupled to a first side of said housing and at least one of said static eliminators is coupled to a second side of said housing.

26. An apparatus for treating a continuous web of material comprising:

a housing coupled to a vacuum source, said housing having at least one aperture through which said web is fed for treatment, wherein said web is treated as it moves through said aperture, and a controller which enables said apparatus when said web is moving through said apparatus and disables said apparatus when said web is stationary.

27. An apparatus for treating a web of material comprising:

a housing coupled to a vacuum source, said housing having at least one slot defining means through which said web is passed for treatment, wherein said web is treated as it moves through said slot by at least the application of negative pressure from said vacuum source for the removal of contaminants from both the upper and lower sides of said web, and having guides for maintaining said web in a desired configuration within said slot, wherein said housing is self-contained to enable positioning of said apparatus at any desired position for treatment of said web.

* * * * *